United States Patent [19]

Cordea et al.

[11] Patent Number: 4,822,556

[45] Date of Patent: Apr. 18, 1989

[54] AUSTENITIC STAINLESS STEEL COMBINING STRENGTH AND RESISTANCE TO INTERGRANULAR CORROSION

[75] Inventors: James N. Cordea, Monroe; Joseph C. Jasper, Middletown, both of Ohio; Harshad V. Sheth, Rancho Palos Verdes, Calif.

[73] Assignee: Baltimore Specialty Steels Corporation, Baltimore, Md.

[21] Appl. No.: 19,448

[22] Filed: Feb. 26, 1987

[51] Int. Cl.[4] ..... C22C 38/58

[52] U.S. Cl. ..... 420/59; 420/57; 420/58; 148/327

[58] Field of Search ..... 148/327; 420/56, 57, 420/58, 59; 175/409

[56] References Cited

U.S. PATENT DOCUMENTS

| | | | |
|---|---|---|---|
| Re. 28,772 | 4/1976 | Denhard et al. | 420/59 |
| 2,193,222 | 3/1940 | Browne | 420/54 |
| 3,082,083 | 3/1963 | Levy et al. | 420/59 |
| 3,112,195 | 11/1963 | Souresny | 420/59 |
| 3,151,979 | 10/1964 | Carney et al. | 420/59 |
| 3,607,239 | 9/1971 | Mimino et al. | 420/44 |
| 3,940,266 | 2/1976 | Goller et al. | 420/59 |
| 4,337,088 | 6/1982 | Moses | 420/44 |
| 4,502,886 | 3/1985 | Cordea et al. | 420/56 |
| 4,514,236 | 4/1985 | Cook et al. | 420/59 |

FOREIGN PATENT DOCUMENTS

| | | | |
|---|---|---|---|
| 58-107477 | 6/1983 | Japan | 420/59 |
| 61-00418 | 1/1986 | Japan . | |
| 882983 | 11/1961 | United Kingdom . | |
| 1142582 | 2/1969 | United Kingdom . | |

OTHER PUBLICATIONS

*Corrosion–Nace* vol. 30, No. 1 pp. 1–12, Jan. 1974.

*Blast Furnace and Steel Plant,* Dec. 1955, pp. 1377–1380.

*Primary Examiner*—Deborah Yee

*Attorney, Agent, or Firm*—L. A. Fillnow; R. J. Bunyard; R. H. Johnson

[57] ABSTRACT

A nonmagnetic austenitic stainless steel and articles such as drill collars or boat shafts fabricated therefrom, the steel having a 0.2% yield strength of at least 100 ksi (689 N/mm$^2$), improved resistance to intergranular stress corrosion, good ductility, good corrosion resistance and low magnetic permeability, and consisting essentially of, in weight percent, from greater than 0.05% to about 0.10% carbon, greater than 14% to about 18% manganese, about 15% to about 20% chromium, about 1% to about 3.5% nickel, about 0.3% to about 0.55% nitrogen, about 0.10% to about 0.5% vanadium, about 1.0% maximum copper, about 1.0% maximum molybdenum, about 1.0% maximum silicon, about 0.04% maximum phosphorous, about 0.03% maximum sulfur, and balance essentially iron.

13 Claims, No Drawings

AUSTENITIC STAINLESS STEEL COMBINING STRENGTH AND RESISTANCE TO INTERGRANULAR CORROSION

BACKGROUND OF THE INVENTION

This invention relates to nonmagnetic austenitic stainless steels which are balanced in composition to provide a 0.2% yield strength of at least 100 ksi (689 $N/mm^2$) in the hot-worked or forged condition, improved resistance to intergranular attack and to the production of drill collars fabricated therefrom.

Directional drilling of oil wells requires a nonmagnetic drill collar to insure the proper functioning of the electronic measuring and guiding instruments. The greater drilling depths require steels which have improved strengths and also the capability to resist stress corrosion cracking and particularly intergranular stress corrosion cracking caused by high levels of chlorides in the drilling mud and sea water.

Intergranular stress corrosion cracking is believed to be caused by the depletion of chromium at the grain boundaries due to the formation of chromium carbides and nitrides and accelerated by the application of a tensile stress across the grain boundaries. If the carbon level is reduced to below about 0.03% or strong carbide forming elements, such as niobium or titanium, are added, the resistance to intergranular attack has been improved in many austenitic stainless steels. Other steels have higher chromium levels to allow for the depletion. This has been the typical approach to solve the problem.

Since precipitation of carbides and nitrides will depend not only on composition, but also time and temperature, the process of producing the drill collars will influence the properties of the finished collar.

Existing drill collar alloys fall into some general categories. One group will typically have about 13% chromium, 0.06% carbon, 17% manganese, 0.3% nitrogen, 2% nickel and 0.3% niobium. The other family of alloys will typically have about 17.5% chromium, 0.15% carbon, 11% to 17% manganese, 0.3% to 0.35% nitrogen, 0.5% to 6% nickel and no niobium.

The first group uses low chromium levels to simplify keeping the composition nonmagnetic. Lower levels of carbon and nitrogen are required and the addition of niobium provides the additional strength to compensate for the low carbon and nitrogen. High manganese levels are required for austenite stability.

The second group of alloys has higher chromium levels for corrosion resistance. This necessitated the higher levels of carbon and/or nitrogen to maintain an austenitic structure which is nonmagnetic. Since the carbon levels are high, the manganese range can be less restrictive for austenite stability. No niobium is used to add strength and stabilize the carbon. This eliminates another ferrite former from the system and relies upon the carbon and nitrogen for strength.

Both groups of alloys illustrate the importance of balancing the composition to be nonmagnetic and capable of generating high strength levels. However, both approaches will be inadequate in developing the level of resistance to intergranular stress corrosion cracking required for the environment of drill collars.

The present invention provides a composition balance and processing conditions to allow the production of drill collars having the combination of properties including strength, nonmagnetic stability, and resistance to intergranular stress corrosion.

BRIEF SUMMARY OF THE INVENTION

This invention has found the composition balance within critical ranges of the essential elements chromium, manganese, nickel, carbon, nitrogen, copper, molybdenum, iron and especially vanadium to develop a steel particularly suited for drill collars. The nonmagnetic austenitic steel in the hot-worked or forged condition will have a 0.2% yield strength of at least 100 ksi (689 $N/mm^2$), and typically greater than 110 ksi (760 $N/mm^2$), resistance of at least 24 hours in the A262E test for intergranular corrosion and a magnetic permeability not greater than 1.004 at 500 oersteds.

The steels of the invention consist essentially of, in weight percent, greater than 0.05% to about 0.10% carbon, greater than 14% to about 18% manganese, about 15% to about 20% chromium, about 0.3% to about 0.55% nitrogen, about 1% to about 3.5% nickel, about 0.1% to about 0.5% vanadium, about 1% maximum copper, about 1% maximum molybdenum, about 1% maximum silicon, about 0.04% maximum phosphorus, about 0.03 maximum sulfur and balance essentially iron with minor amounts of unavoidable impurities which do not adversely affect the properties.

Drill collars hot forged from the the steel of this invention do not require warm working to provide the outstanding levels of strength. When the steel billet is finished forged above 1380° F. (750° C.) and quenched to minimize the precipitation of carbides and nitrides, the drill collar has excellent resistance to intergranular attack. The drill collars of the invention are further characterized by a fine grain size (ASTM 6 or smaller) and more uniform properties from the center to the surface. This benefit results from the controlled addition of vanadium, compared to the typical additions of the stronger carbide formers such as niobium, titanium and others.

The composition is balanced to maintain an austenitic structure during all conditions of manufacture and use. The balanced composition also permits greater flexibility in processing to allow air, water or oil quenching to be used after finishing the forging step while producing substantially equivalent properties. The use of vanadium and a better combination of carbon and nitrogen results in improved resistance to intergranular attack and sensitization while maintaining excellent strength and a nonmagnetic structure. The strengths of the drill collars are obtained with less reductions than previously required.

DETAILED DESCRIPTION

Ingots or billets having a composition in accordance with the present invention are heated above 2000° F. (1095° C.) and hot reduced by forging to the desired outside diameter which ranges up to about 1 foot (0.3 meters) in diameter and to lengths from about 15 feet (4.5 meters) to over 30 feet (9 meters). The forged material is then trepanned to form the desired bore diameter. Minimization of stress in drill collars resulting from processing is helpful to reduce stress corrosion cracking. Drill collars may also vary in properties depending on the diameter, processing and where the properties are measured.

The steels of the invention consist essentially of, in weight percent, greater than 0.05% to about 0.10% carbon, greater than 14% to about 18% manganese, about 15% to about 20% chromium, about 0.3% to about 0.55% nitrogen, about 1% to about 3.5% nickel, about 0.1% to about 0.5% vanadium, about 1% maximum copper, about 1% maximum molybdenum, about 1% maximum silicon, about 0.04% maximum phosphorus, about 0.03% maximum sulfur and balance essentially iron except for normal residual elements.

Carbon is required for its function as a strong austenite former and its contribution to strength. In order to also provide good resistance to intergranular corrosion, the level of carbon must be balanced to avoid excessive amounts of grain boundary carbides. While carbon is normally maintained below 0.03% for excellent resistance to intergranular attack, the present carbon level of above 0.05% to 0.10% provides good resistance to intergranular corrosion while retaining high strength and austenite stability. A preferred level of carbon is from 0.055% to 0.085%.

Several patents, such as U.S. Pat. Nos. 4,341,555, 3,645,725 and 3,926,620 have taught manganese should be restricted to levels below the present range to provide an alloy with good intergranular corrosion resistance. Manganese will form austenite but is added primarily to stabilize the austenite and provide the basis for holding large amounts of carbon and nitrogen in solution. Manganese above 14% is required to keep the nitrogen and carbon in solution. Contrary to the teachings of U.S. Pat. No. 4,502,886, manganese above 14% does not adversely affect the mechanical properties but allows the levels of strength to be improved because of higher nitrogen contents. The upper limit of manganese is restricted to about 18% to minimize the risk of hot shortness when copper is present. Higher levels of manganese also tend to form undesirable precipitates which lower the intergranular resistance. Higher levels of manganese may also contribute to the presence of ferrite. A prefered range of manganese is from 14.5% to 16%.

Chromium is present from about 15%–20% to insure good general corrosion resistance and maintain the fully austenitic balance with the alloy. A preferred range of 16–18% provides the optimum properties when balanced with the other elements in the composition and particularly the higher levels of nitrogen.

Nitrogen is a key element in developing the high strength levels of this alloy and is present from about 0.3% to 0.55%. The level of nitrogen must not exceed the solubility limits of the alloy. The higher than normal levels of manganese allow these higher levels of nitrogen to be in solution. Preferably the nitrogen will range between 0.38% to 0.5%. Nitrogen is also a grain boundary corrosion sensitizing element although not as aggressive as carbon. An approximate comparison of 0.02% nitrogen is equivalent to 0.01% carbon on the basis of forming nitrides vs. carbides with chromium. Complete stabilization to control intergranular corrosion would thus involve consideration of the large levels of nitrogen as well as the carbon. The high levels of nitrogen allow the chromium content to be increased while maintaining an austenitic structure.

Vanadium has long been considered with niobium and titanium as a stabilizing element but has not been used much because it is not as strong a carbide former as the other elements. Niobium is generally regarded as a better strengthening agent also. Stabilizing elements must be used with caution in drill collar alloys for several reasons. Niobium, titanium, vanadium, tantalum, zirconium and others are strong ferrite formers and are usually avoided in a nonmagnetic alloy. Vanadium is the strongest ferrite former of the stabilizing elements. When these elements combine with carbon or nitrogen, they remove strong austenite formers and stabilizers from the system which must be rebalanced to insure a nonmagnetic structure. The addition of about 0.1% to about 0.5% vanadium provides improved properties when balanced properly with manganese and nitrogen additions. Vanadium helps to provide a grain size of ASTM 6 or smaller which improves strength and reduces intergranular stress corrosion. The vanadium appears to form fine precipitates which act as solid solution strengtheners. Vanadium carbides and nitrides are very fine and uniformly distributed compared to niobium carbides which are massive and not uniformly distributed. Preferably the vanadium addition is about 0.25% to 0.4% to provide the optimum balance of grain size, resistance to intergranular stress corrosion, stable austenitic structure and good forging characteristics. U.S. Pat. No. 4,514,236 relates to drill collars having a vanadium addition. The preferred steel composition is 0.2% to 0.4% carbon, 10% to 16% chromium, 1% maximum nickel, 12% to 20% manganese, 0.2% to 0.6% nitrogen and 0.2% to 1% vanadium. This alloy would suffer from intergranular attack because of the high carbon content. The vanadium addition in the present invention provides a much more uniform and clean microstructure because of the balance with carbon and nitrogen which is lacking in the prior art.

Nickel is an element normally relied upon for providing an austenitic structure. The upper limit of nickel in this invention is about 3.5% to avoid extensive stress corrosion cracking. A minimum level of about 1% is desired to provide an austenitic structure. A preferred range for nickel is about 1.5% to 2.5%.

Copper is a beneficial addition up to about 1%. Copper functions as an austenite former, helps to stabilize the austenite to resist transformation to martensite and lowers the work hardening rate. Copper above 1% may cause a problem with hot shortness due to the high levels of manganese present.

Molybdenum is commonly present as an impurity but when purposely added is restricted to a maximum of 1.0% and preferably 0.75% maximum. Molybdenum is a ferrite former and must be balanced with additional austenite forming elements. Molybdenum is also a carbide former which lowers the austenite stability by removing carbon in solution.

Phosphorus, sulfer and silicon are commonly present as impurities. Phosphorus is limited to about 0.04% maximum, sulfur is limited to about 0.03% maximum and silicon is limited to about 1% maximum. Preferably silicon is less than 0.75% since it is a ferrite former.

Any one or more of the preferred or more preferred ranges indicated above can be used with any one or more of the broad ranges for the remaining elements in this iron base alloy.

Preferably drill collars in accordance with the invention will be processed to provide the combination of properties discussed above. Ingots, blooms or billets of the composition of the invention are heated above about 2100° F. (1150° C.) and hot reduced by forging. A preferred forging practice has been developed using a precision rotary forging system. Four mechanically driven hammers impact the rotated workpiece into a round bar. The workpiece is passed back and forth to forge the entire length. U.S. Pat. Nos. 3,850,022 and 4,430,882 are representative of this forging machine. Obviously, other forging practices could be used to produce drill collars from the composition of the invention. Blooms ranging from 10 inches (25 cm) to 20 inches (50 cm) are charged into a rotary hearth furnace. After soaking at above 2100° F. (1150° C.), the blooms are forged using the precision rotary forge device to bars up to about 12 inches (30 cm) in diameter and typically 30 feet (10 m) or longer. After the final forging pass, the bars were air or water cooled from a temperature above the sensitizing range [1375° F.–1400° F. (745° C. to 760° C.)] to room temperature. The limited precipitation of vanadium carbides and nitrides at the grain boundaries is not detrimental to the intergranular stress corrosion resistance. Without vanadium additions or the use of other carbide formers, the drill collars must be water quenched to avoid the critical sensitizing range. The forged bars are then trepanned to form a central bore of the desired diameter.

Drill collars produced according to the invention will have the following properties determined at the 75% radius position:

(1) Magnetic permeability of 1.004 maximum.

(2) 0.2% yield strength of 100 ksi (689 $N/mm^2$) minimum.

(3) Resistance to intergranular attack (as measured by the ASTM A262E test) for at least 24 hours.

(4) Grain size ASTM 6 or smaller.

(5) % elongation in 2 inches (5 cm) of at least 25%.

(6) % reduction in area of at least 40%.

The nonmagnetic alloy of the present invention is particularly suited for down-hole equipment such as drill collars or stabilizers but may be produced into various product forms such as bar, rod, wire and castings. Applications, while not limiting, include boat shafts and other marine products such as rudders, pump shafts and piston rods. The stainless steel articles have particular utility in applications requiring high strength, austenitic stability under all conditions, and good resistance to intergranular and stress corrosion cracking. The alloy is also well suited for the production of nonmagnetic generator rings.

A series of heats have been processed and tested. The compositions are reported in Table 1 and the properties in Table II. The properties are for drill collars fabricated from these heats with the test positions being at 75% radius and center location. The properties represent the as-forged condition without warm working. The steels of the invention meet the desired combination of properties for yield strength, nonmagnetic permeability and resistance to intergranular corrosion. The composition also provides excellent properties for forging as measured by the reduction of area and elongation results.

ASTM A-262 Practice E is a test used to detect susceptability to intergranular corrosion which is more sensitive than the previous Strauss test. The test requires the material be immersed for 24 hours in a boiling solution of 10% sulfuric acid - 10% copper sulfate solution and with the test sample in contact with metallic copper. After exposure for 24 hours, the samples are bent 180° and visually examined as acceptable or nonacceptable. All of the steels of the invention containing carbon below 0.11% and vanadium passed the 262E test for good resistance to intergranular corrosion.

The mechanical properties in Table II show the excellent combination of properties with the steels of the invention. The amount of hot working during forging is evident by the higher strengths for the smaller drill collar sizes. The requirements for cooling after forging are more flexible with this alloy due to the vanadium addition. For the diameters above 10 inches (25 cm), water quenching is preferred over an air cool. Table III more clearly illustrates the relationship between properties and the finish forge temperature. Clearly the strengths can be increased, if needed, by lowering the finish forge temperature. The properties for Tables II and III are measured just below the surface (75% radius) and at the center of the bar.

Table IV provides a listing of the competitive drill collar alloys which could be sampled and evaluated. The use of niobium as the accepted strengthening addition for combining with carbon and nitrogen is obvious. Heat H is example 3 from U.S. Pat. No. 4,514,236 and represents a vanadium modified drill collar. Because of the large amounts of carbon (0.34%), the alloy would suffer from intergranular corrosion but would possess acceptable strength. The reduction in area % is very low for this high carbon and high nitrogen alloy. The mechanical properties for the alloys of Table IV are shown in Table V. Alloys 1 and 2 of the invention clearly demonstrate vanadium is surprisingly equivalent to niobium in providing excellent strengths and good ductility. When balanced properly, the very strong ferrite forming tendencies may be overcome to provide a nonmagnetic structure suitable for drill collars. The intermediate carbon levels of greater than 0.05% to 0.10%, high nitrogen contents of 0.3 to 0.55%, high manganese levels of greater than 14% to 18%, low nickel amounts of about 1% to 3.5%, and chromium contents of 15% to 20% provide an alloy balance with outstanding properties not previously thought possible with the weak stabilizing element vanadium.

The grain size of the alloy after forging is important. Table VI measures the resistance to intergranular stress corrosion by both the A262E test and the 10% NaCl +0.5% Acetic Acid boiling solution. The 10% NaCl/0.5% Acetic Acid provides a better comparative test for resistance to stress corrosion cracking than the accepted 24 hour A262E test which is a pass or fail test. It is evident that the fine grain size dramatically improves the stress corrosion resistance when comparing an ASTM 5 with ASTM 8. Table VI also shows a 0.15% carbon alloy will not pass the A262E test, regardless of the grain size.

While the invention has been described primarily with reference to the production of nonmagnetic drill collars, it will be understood that the invention has utility for other applications requiring a combination of strength, resistance to intergranular stress corrosion, and freedom from magnetic effects. Accordingly, no limitations are to be inferred except as set forth in the appended claims.

TABLE I

| | Drill Collar Bar Compositions (Weight %) | | | | | |
|---|---|---|---|---|---|---|
| Heat | % C | % Mn | % Cr | % Ni | % N | % V |
| 1* | 0.068 | 15.15 | 17.27 | 2.13 | 0.43 | 0.34 |
| 2* | 0.072 | 15.02 | 17.23 | 2.13 | 0.42 | 0.36 |
| 3* | 0.071 | 14.80 | 17.16 | 2.21 | 0.43 | 0.33 |
| 4 | 0.15 | 12.90 | 17.28 | 2.19 | 0.35 | |
| 5 | 0.16 | 12.5 | 18.1 | 2.6 | 0.41 | |

*Steels of the Invention

All Heats: About 0.5% Cu, <0.5% Mo, <0.04% P <0.01% S, 0.3 to 0.6% Si, Balance Fe

TABLE II

| Heat | Bar Size | Quench | Mechanical Properties A262E | Y.S. (ksi) | T.S. (ksi) | Properties Elong (%) | Red Area (%) | Test Location |
|---|---|---|---|---|---|---|---|---|
| 1* | 4⅝" | Water | P | 134 | 152 | 30 | 61 | ¾ R |
| | (11.7 cm) | | | 135 | 154 | 30 | 59 | C |
| 1* | 5¼" | Air | P | 114 | 142 | 35 | 63 | ¾ R |
| | (13.3 cm) | | | 114 | 142 | 35 | 64 | C |
| 1* | 7" | Water | P | 126 | 146 | 30 | 64 | ¾ R |
| | (17.8 cm) | | | 114 | 140 | 35 | 66 | C |
| 1* | 8½" | Water** | P | 131 | 152 | 30 | 60 | ¾ R |
| | (21.6 cm) | | | 110 | 140 | 35 | 66 | C |
| 1* | 8½" | Air** | P | 132 | 151 | 31 | 59 | ¾ R |
| | (21.6 cm) | | | 113 | 138 | 35 | 64 | C |
| 2* | 10½" | Water | P | 130 | 153 | 28 | 59 | ¾ R |
| | (26.7 cm) | | | 101 | 138 | 36 | 63 | C |
| 3* | 11½" | Water | P | 112 | 142 | 33 | 62 | ¾ R |
| | (29.2 cm) | | | 88 | 129 | 45 | 68 | C |
| 4** | 7¼" | Water | F | 110.4 | 139.6 | 37 | 60 | OD |
| | (18.4 cm) | | | | | | | |
| 5*** | 7¾" | (#4 from | F | 107.3 | 142.4 | 34.8 | 56.6 | OD |
| | (19.7 cm) | 4,502,886) | | | | | | |

*Steels of the Invention
**1450° F. Quench (790° C.)
***Hot forged 1250° F. to 1400° F. (675° C. to 760° C.)
All heats were quenched from a final forge temperature of 1500° F. (815° C.) To convert ksi to N/mm² or MPa, multiply by 6.89

TABLE III

| Heat | Temperature | Quench | Mechanical Properties - 7" Bar Y.S. (ksi) | T.S. (ksi) | Properties Elong (%) | Red Area (%) | Test Location |
|---|---|---|---|---|---|---|---|
| 1* | 1545° F. | Water | 114 | 140 | 36 | 65 | ¾ R |
| | (840° C.) | | 98 | 133 | 39 | 70 | C |
| 1* | 1500° F. | Water | 126 | 146 | 30 | 64 | ¾ R |
| | (815° C.) | | 114 | 140 | 35 | 66 | C |
| 1* | 1445° F. | Water | 135 | 152 | 30 | 62 | ¾ R |
| (6¾") | (785° C.) | | 140 | 155 | 29 | 62 | C |
| (17.1 cm) | | | | | | | |
| 1* | 1405° F. | Water | 137 | 154 | 30 | 61 | ¾ R |
| | (765° C.) | | 129 | 147 | 33 | 62 | C |

To convert ksi to N/mm² or MPa, multiply by 6.89

TABLE IV

| Alloy | % C | % Mn | % Si | % Cr | % Ni | % N | % Nb | % V |
|---|---|---|---|---|---|---|---|---|
| | Competitive Drill Collar Alloys (Weight %) | | | | | | | |
| A | 0.11 | 17.18 | 0.41 | 17.69 | 0.50 | 0.45 | — | — |
| B | 0.06 | 17.61 | 0.30 | 13.54 | 2.21 | 0.27 | 0.31 | — |
| C | 0.17 | 10.85 | 0.40 | 17.32 | 6.23 | 0.26 | — | — |
| D | 0.06 | 17.81 | 0.29 | 12.85 | 1.73 | 0.30 | 0.42 | — |
| E | 0.05 | 17.76 | 0.75 | 12.46 | 1.61 | 0.27 | — | — |
| F | 0.17 | 12.33 | 0.33 | 17.97 | 2.24 | 0.37 | — | — |
| G | 0.08 | 17.15 | 0.36 | 12.79 | 1.96 | 0.27 | 0.29 | — |
| H | 0.34 | 18.7 | 0.53 | 14.0 | — | 0.46 | — | 0.59 |
| 1* | 0.068 | 15.15 | 0.48 | 17.27 | 2.13 | 0.43 | — | 0.34 |
| 2* | 0.072 | 15.02 | 0.54 | 17.23 | 2.13 | 0.42 | — | 0.36 |

*Steels of the Invention

TABLE V

| Alloy | Diameter | Mechanical Properties - O.D. .2% Y.S. (ksi) | UTS (ksi) | % Elong (in 2") | % RA | Mag. Perm. |
|---|---|---|---|---|---|---|
| A | 4⅞" (12.4 cm) | 137.3 | 157.4 | 30.3 | 61.4 | 1.0018 |
| B | 4¾" (12.1 cm) | 109.3 | 131.3 | 33.0 | 65.3 | 1.0021 |
| C | 4 3/16" (10.6 cm) | 114.8 | 138.3 | 27.1 | 52.5 | 1.0022 |
| D | 6½" (16.5 cm) | 107.8 | 125.8 | 34.5 | 59.6 | 1.0020 |
| E | 4¾" (12.1 cm) | 107.8 | 128.3 | 37.4 | 70.1 | 1.0021 |
| F | 6½" (16.5 cm) | 84.7 | 119.3 | 44.1 | 56.9 | 1.0021 |
| G | 6¼" (15.9 cm) | 131.8 | 145.8 | 27.0 | 50.9 | 1.0020 |
| H | 7⅞" (20.0 cm) | 104.5 | 150.9 | 35 | 42 | 1.01 max. |

TABLE V-continued

| Alloy | Diameter | Mechanical Properties - O.D. .2% Y.S. (ksi) | UTS (ksi) | % Elong (in 2") | % RA | Mag. Perm. |
|---|---|---|---|---|---|---|
| 1* | 4⅝" (11.7 cm) | 133.8 | 152.4 | 30.5 | 61 | 1.0016 |
| 1** | 6¾" (17.1 cm) | 135.6 | 152.5 | 30 | 61.5 | 1.0016 |
| 2** | 7¾" (19.7 cm) | 129.9 | 152.9 | 27 | 60 | 1.0017 |

*1500° F. Finish Forge with Water Quench (815° C.)
**1450° F. Finish Forge with Water Quench (790° C.)
To convert ksi to N/mm² or MPa, multiply by 6.89

TABLE VI

| Alloy | Grain Size | Stress (ksi) | Grain Size vs. Intergranular Corrosion 10% NaCL* + .5% Acetic Acid | Y.S. (ksi) | V | A262E |
|---|---|---|---|---|---|---|
| 4 | 3–6 | 85 | 1.3 Hrs. | 100.8 | No | F |
| 5 | 7–8 | 85 | 18.2 | 105.3 | No | F |
| 1** | 5 | 90 | 60 | 112.0 | Yes | P |
| 1*** | 8 | 90 | 669 | 112.0 | Yes | P |

*Boiling Solution - time to failure
**Steel of the Invention
***Preferred Steel of the Invention
To convert ksi to N/mm² or MPa, multiply by 6.89

We claim:

1. An austenitic stainless steel having a 0.2% yield strength of at least 100 ksi (689 N/mm²), a magnetic permeability not greater than 1.004 at 500 oersteds, intergranular corrosion resistance of at least 24 hours measured by ASTM A-262 Practice E and a grain size number of ASTM 6 or finer, said steel consisting essentially of, in weight percent, from greater than 0.05% to about 0.10% carbon, greater than 14% to about 18% manganese, about 15% to about 20% chromium, about 1% to about 3.5% nickel, about 0.3% to about 0.55% nitrogen, about 0.1% to about 0.5% vanadium, about 1% maximum copper, about 1% maximum molybdenum, about 1% maximum silicon, about 0.04% maximum phosphorus, about 0.03% maximum sulfur and balance essentially iron.

2. The steel claimed in claim 1, consisting essentially of 0.055% to 0.085% carbon, 14.5% to 16% manganese, 16% to 18% chromium and 0.38% to 0.5% nitrogen.

3. The steel claimed in claim 2 wherein the vanadium is from 0.25% to 0.4% and nickel is from 1.5% to 2.5%.

4. The steel claimed in claim 3, consisting essentially of from 0.4% to 0.5% nitrogen and about 0.75% maximum molybdenum.

5. A nonmagnetic drill collar produced by hot forging an austenitic stainless steel consisting essentially of, in weight %, greater than 0.05% to about 0.10% carbon, greater than 14% to about 18% manganese, about 15% to about 20% chromium, about 1% to about 3.5% nickel, about 0.3% to about 0.55% nitrogen, about 0.10% to about 0.5% vanadium, about 1% maximum copper, about 1% maximum molybdenum, about 1% maximum silicon, about 0.04% maximum phosphorus, about 0.03% maximum sulfur and balance essentially iron with said collar having a 0.2% yield strength of at least 100 ksi (689 $N/mm^2$), a magnetic permeability not greater than 1.004 at 500 oersteds, a grain size of ASTM 6 or finer, and intergranular corrosion resistance of at least 24 hours measured by the ASTM A-262 Practice E test.

6. The nonmagnetic drill collar claimed in claim 5, consisting essentially of from 0.055% to 0.085% carbon, 16% to 18% chromium, from 0.38% to 0.5% nitrogen, and from 14.5% to 16% manganese.

7. The drill collar claimed in claim 6 wherein the vanadium is from 0.25% to 0.4% and nickel is from 1.5% to 2.5%.

8. The drill collar claimed in claim 7 wherein the nitrogen is from 0.4% to 0.5% and the maximum molybdenum is about 0.75%.

9. Stainless steel bar, rod, wire and forgings exhibiting no intergranular failure after 24 hours exposure to the ASTM A-262 Practice E test solution, having a magnetic permeability of less than 1.004 at 500 oersteds, having a 0.2% yield strength of at least 100 ksi (689 $N/mm^2$), freedom from harmful carbides and nitrides at the grain boundaries, and a grain size number of ASTM 6 or finer, said article consisting essentially of, in weight percent, from greater than 0.05% to about 0.10% carbon, greater than 14% to about 18% manganese, about 15% to about 20% chromium, about 1% to about 3.5% nickel, about 0.3 to about 0.55% nitrogen, about 0.1% to 0.5% vanadium, about 1% maximum silicon, about 0.04% maximum phosphorus, about 0.03% maximum sulfur and balance essentially iron.

10. Stainless steel bar, rod, wire and forgings according to claim 9 consisting essentially of from 0.055% to 0.085% carbon, 16% to 18% chromium, from 1.5% to 2.5% nickel, from 0.4% to 0.5% nitrogen, from 14.5% to 16% manganese, from 0.25 to 0.4% vanadium, about 0.75% maximum molybdenum and balance essentially iron.

11. The stainless steel claimed in claim 1 wherein the 0.2% yield strength is greater than 110 ksi (760 $N/mm^2$).

12. The drill collar claimed in claim 5 wherein the 0.2% yield strength is greater than 110 ksi (760 $N/mm^2$).

13. The stainless steel bar, rod, wire and forgings claimed in claim 9 wherein the 0.2% yield strength is greater than 110 ksi (760 $N/mm^2$).

* * * * *